US011322884B2

(12) United States Patent
Krome

(10) Patent No.: US 11,322,884 B2
(45) Date of Patent: May 3, 2022

(54) APPARATUS FOR CONNECTING AND DISCONNECTING AN ELECTRICAL CONNECTION

(71) Applicant: PHOENIX CONTACT GMBH & CO. KG, Blomberg (DE)

(72) Inventor: Karsten Krome, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/757,927

(22) PCT Filed: Oct. 18, 2018

(86) PCT No.: PCT/EP2018/078560
§ 371 (c)(1),
(2) Date: Apr. 21, 2020

(87) PCT Pub. No.: WO2019/081340
PCT Pub. Date: May 2, 2019

(65) Prior Publication Data

US 2020/0266580 A1 Aug. 20, 2020

(30) Foreign Application Priority Data

Oct. 23, 2017 (DE) ..... 10 2017 218 876.6

(51) Int. Cl.
*H01R 13/625* (2006.01)
*H01R 13/623* (2006.01)
(Continued)

(52) U.S. Cl.
CPC ..... *H01R 13/625* (2013.01); *H01R 13/623* (2013.01); *H01R 13/6271* (2013.01); *H01R 13/62927* (2013.01); *H01R 13/635* (2013.01)

(58) Field of Classification Search
CPC ..... H01R 13/625; H01R 13/623; H01R 13/62927; H01R 13/635; H01R 13/6271;
(Continued)

(56) References Cited

U.S. PATENT DOCUMENTS 5,655,916 A 8/1997 Hiroyuki
5,746,619 A 5/1998 Harting et al.
(Continued)

FOREIGN PATENT DOCUMENTS

CN 205004541 1/2016
CN 106450937 2/2017
(Continued)

OTHER PUBLICATIONS

English translation of International Preliminary Report on Patentability from corresponding PCT Appln. No. PCT/EP2018/078560, dated May 7, 2020.
(Continued)

*Primary Examiner* — Travis S Chambers
(74) *Attorney, Agent, or Firm* — Grossman, Tucker, Perreault & Pfleger, PLLC

(57) ABSTRACT

An apparatus for connecting and disconnecting an electrical connection, comprising a socket, a male plug that can be connected to the socket, and a coupling mechanism which is designed for locking the socket to the male plug and for separating it therefrom.

11 Claims, 8 Drawing Sheets

(51) Int. Cl.
*H01R 13/629* (2006.01)
*H01R 13/635* (2006.01)
*H01R 13/627* (2006.01)

(58) Field of Classification Search
CPC ..... H01R 13/629; H01R 13/6272; H01R 13/6273; H01R 13/6275
See application file for complete search history.

(56) References Cited

U.S. PATENT DOCUMENTS

| | | | | |
|---|---|---|---|---|
| 6,796,827 | B1 | 9/2004 | Chen | |
| 7,201,608 | B2 | 4/2007 | Rosenberger et al. | |
| 7,699,651 | B2 * | 4/2010 | Rosenberger | H01R 13/633 439/578 |
| 8,087,954 | B2 * | 1/2012 | Fuchs | H01R 24/40 439/578 |
| 9,297,965 | B2 * | 3/2016 | Schmidt | G02B 6/3893 |
| 9,548,558 | B1 | 1/2017 | Hsu et al. | |
| 2007/0232116 | A1 * | 10/2007 | Bernat | H01R 13/6275 439/347 |
| 2015/0236446 | A1 | 8/2015 | Razaghi et al. | |

FOREIGN PATENT DOCUMENTS

| | | |
|---|---|---|
| DE | 9204991 | 6/1992 |
| DE | 29517258 | 2/1996 |
| DE | 202004007909 | 8/2004 |
| EP | 2631995 | 8/2013 |
| JP | 58118683 | 8/1983 |
| JP | S61180310 | 8/1986 |
| JP | 2012-59400 | 3/2012 |

OTHER PUBLICATIONS

English translation of International Search Report from corresponding PCT Appln. No. PCT/EP2018/078560, dated Nov. 28, 2018.
Office Action from related Japanese Appln. No. 2020-522849, dated Jun. 21, 2021. English translation attached.

* cited by examiner

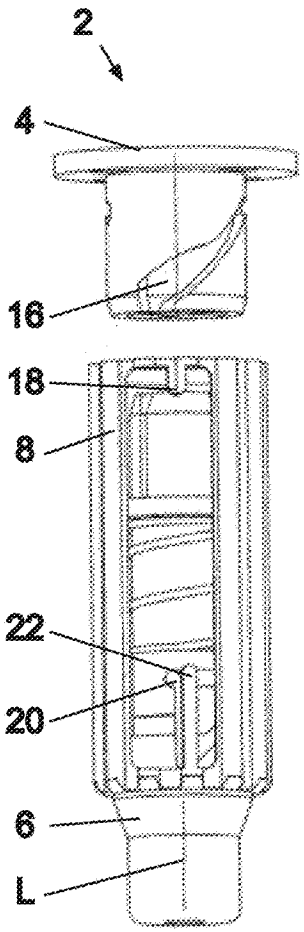
Fig. 1K
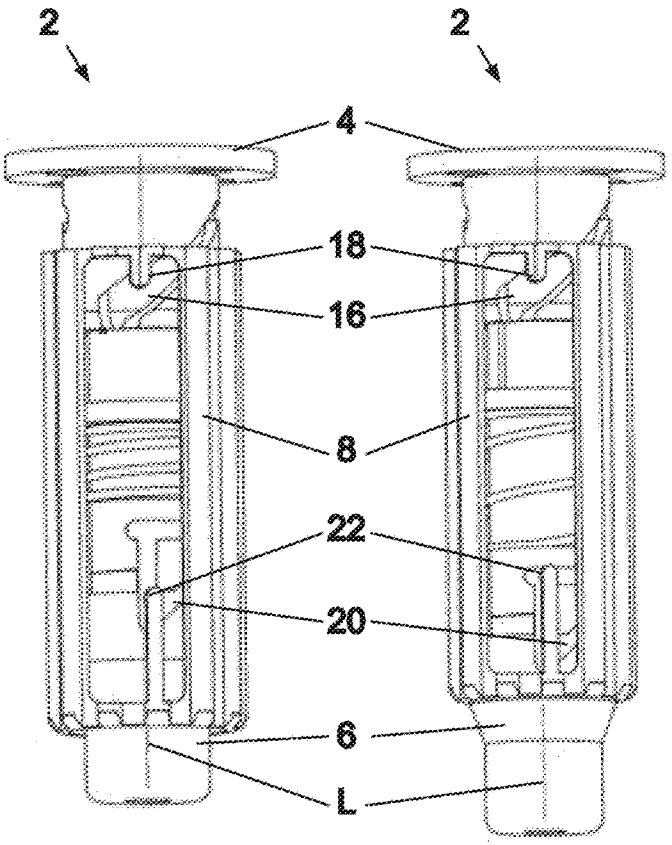
Fig. 1J
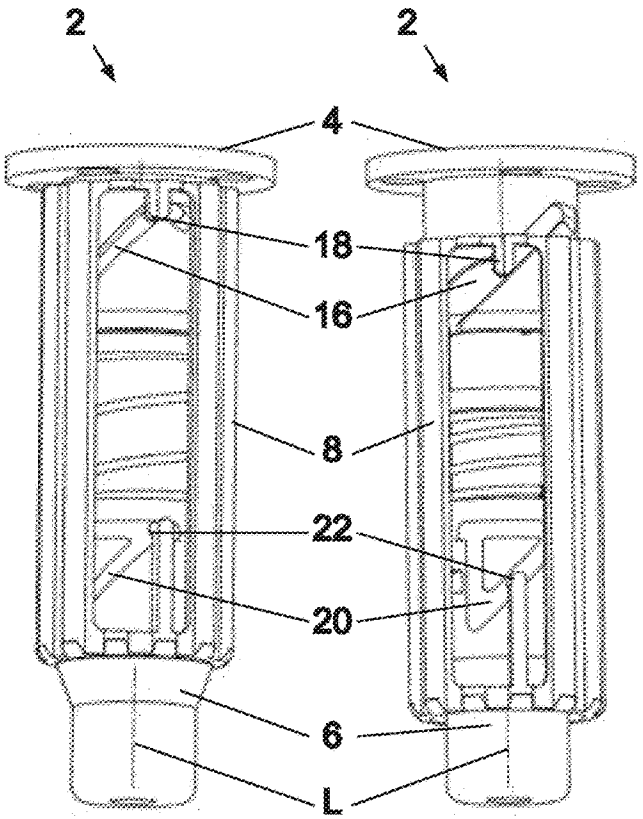
Fig. 1I
Fig. 1H
Fig. 1G

APPARATUS FOR CONNECTING AND DISCONNECTING AN ELECTRICAL CONNECTION

FIELD

The invention relates to an apparatus for connecting and separating an electrical connection.

BACKGROUND

The contact surfaces of electrical plug connections are subjected to wear as a result of loss of material as they are separated under load. As an electrical plug connection is separated under load, the separation rate at which the contact surfaces are moved away from one another is decisive as far as the wear as a result of loss of material is concerned. A rapid separation of the contact surfaces may in this case reduce the wear as a result of loss of material and increase the serviceable life of the contacts. However, as conventional connections are released, this separation rate depends upon the respective user or installer. Thus, plug connections may have an increased amount of wear as a result of loss of material depending upon the operator and consequently as a result thereof have a reduced serviceable life.

SUMMARY

In view of the above, the invention is based on solving the technical problem of providing for connecting and separating an electrical connection an apparatus that does not have the above-mentioned disadvantages or at least only has them to a lesser extent and in particular that renders it possible for a plug connection to be separated irrespective of the separating force and separation rate produced by the user.

The invention relates to an apparatus for connecting and separating an electrical connection comprising a socket, a male connector that may be connected to the socket and a coupling mechanism that is configured so as to lock the socket to the male connector and separate it therefrom, wherein the coupling mechanism has a releasable positive-locking connection for connecting the socket and the male connector, a releasing sleeve for releasing the releasable positive-locking connection and an ejection spring for separating the socket and the male connector, wherein the socket and the male connector are in contact with one another in a first position of the releasing sleeve and are secured by means of the releasable positive-locking connection to prevent them becoming detached in the axial direction, wherein the releasing sleeve is movable out of the first position into a second position while the ejection spring is pre-stressed, wherein the releasing sleeve is configured so as upon reaching the second position to release the positive-locking connection between the socket and the male connector and wherein the ejection spring is configured so as after releasing the positive-locking connection to move the socket and the male connector in an axially manner and separate them.

The plug connection may be separated with a defined separating force and separation rate by way of incorporating the ejection spring in combination with the releasable, positive-locking connection. It is thus possible to separate the connection repeatably irrespective of the user in order to reduce the wear as a result of loss of material during the separation procedure under load.

It is possible to provide that the ejection spring is received and may be pre-stressed between a collar, which is formed on the releasing sleeve, and a collar, which is formed on the male connector. It is thus possible in a simple and cost-effective manner to reliably incorporate the ejection spring into the apparatus.

In accordance with alternative embodiments of the invention, the ejection spring may be received and arranged such that it may be pre-stressed between the releasing sleeve and the socket.

The spring may be a helical compression spring. Cost-effective and high quality helical compression springs are available.

According to a further embodiment of the apparatus, it is provided that the ejection spring is not pre-stressed in the first position of the releasing sleeve. Thus, a plug connection that is formed between the socket and the male connector is not loaded by the ejection spring with the result that the sleeve, the socket and the male connector are only loaded by spring forces of the ejection spring during the procedure of separating the plug connection.

In the event that the ejection spring is received by way of example between two collars or webs, it is possible insofar as the sleeve is in its first position for a spacing or clearance to form between the ejection spring and at least one web or collar with the result that the ejection spring is not pre-stressed nor under a load.

As an alternative, it is possible to provide that the ejection spring is slightly pre-stressed in the first position of the releasing sleeve in order to hold the ejection spring in its position.

In accordance with a further embodiment of the invention, it is provided that the releasable, positive-locking connection has a first sliding-block guide, which is formed between the releasing sleeve and the socket, and a second sliding-block guide, which is formed between the releasing sleeve and the male connector, wherein the first sliding-block guide and the second sliding-block guide are configured so as to cause a superimposed rotatory and axial translatory movement of the releasing sleeve out of the first position into the second position.

In so doing, by way of rotating the sleeve, it is possible for a user to slide the sleeve along the sliding-block guides with the result that the spring is axially pre-stressed.

The sliding-block guides are thus part of the releasable, positive-locking connection and are configured so as to render it possible to pre-stress the ejection spring by moving the releasing sleeve out of the first position into the second position, wherein furthermore, during the procedure of pre-stressing the ejection spring, the socket and the male connector are secured by the sliding-block guide in a positive-locking manner to prevent movement in an axial manner relative to one another.

It is further possible to provide that the first sliding-block guide has a first bayonet groove in which a first molded element is guided, and the second sliding-block guide has a second bayonet groove in which a second molded element is guided, wherein the first bayonet groove and the second bayonet groove each have a pre-stressing groove section along which the sleeve is movable so as to pre-stress the spring out of the first position into the second position, wherein either the pre-stressing groove section of the first bayonet groove or the pre-stressing groove section of the second bayonet groove issues into a releasing groove section that extends in an axial manner at least in sections and along which the associated molded element is guided starting from the second position of the releasing sleeve into a third position of the releasing sleeve, while the ejection spring moves the male connector and the socket apart supported against the respective other molded element.

The bayonet grooves therefore render possible a defined and guided pre-stressing and separating movement.

According to a further embodiment of the apparatus, it is provided that the first bayonet groove of the first sliding-block guide is arranged at the peripheral side in the region of an outer peripheral surface of the socket and the second bayonet groove of the second sliding-block guide is arranged in the region of an outer peripheral surface of the male connector, wherein the pre-stressing section of the first bayonet groove and the pre-stressing section of the second bayonet groove are each inclined according to a type of helical section relative to an axial pre-stressing direction of the ejection spring, wherein an incline of the pre-stressing groove section of the first bayonet groove is equal to the incline of the pre-stressing groove section of the second bayonet groove and wherein a first cam that is provided on the sleeve is guided in the first bayonet groove and a second cam that is provided on the sleeve is guided in the second bayonet groove.

Consequently, the ejection spring may be pre-stressed by way of moving the releasing sleeve, wherein the cams of the sleeve are guided in the pre-stressing groove sections of the socket and male connector, wherein as the sleeve is moved an axial relative movement between the socket and the male connector does not occur as a result of the identical inclines of the pre-stressing groove sections.

By way of example, the ejection spring in particular the helical compression spring may be pre-stressed in an axial manner between circumferential webs on the socket and the plug contact, wherein the cams of the releasing sleeve slide in the bayonet grooves, said cams sliding in the bayonet grooves during the procedure of pre-stressing the ejection spring, in cooperation with the bayonet grooves during the procedure of pre-stressing the ejection spring furthermore form a positive-locking connection so as to axial fix the socket on the male connector.

A bayonet groove may have an open groove end and/or a groove side with an opening that is configured so as to feed through the molded element, in particular a cam, in order to render it possible to feed through a molded element while connecting the plug to the socket.

It is possible to provide that a releasing groove section is not formed, wherein the pre-stressing groove section transitions into an outer peripheral surface and the relevant molded element slides freely along the outer peripheral surface without being guided.

According to an alternative embodiment of the apparatus, it is provided that the releasable, positive-locking connection has a clip connection that is formed between the socket and the male connector, said clip connection having a spring arm that engages in an undercut, wherein the releasing sleeve has a releasing geometric shape that is configured so as upon reaching the second position to raise the spring arm from the undercut and to release the clip connection.

In order to render possible a release by way of rotation and also by way of a translatory movement, the releasing sleeve may have according to a further embodiment in addition to the releasing geometry shape a further molded element that is configured so as upon reaching the second position to raise the spring arm from the undercut and to release the clip connection, wherein the further molded element is guided along a sliding-block guide that is configured so as to cause a superimposed rotatory and axial translatory movement of the releasing sleeve out of the first position into the second position.

It is thus possible for a user to separate the plug connection, depending upon the installation space, by way of a translatory movement or rotation of the releasing sleeve.

The releasing geometry shape may be a collar that is circumferential at least in sections. Insofar as by way of example two clip connections are arranged offset with respect to one another by 180°, the releasing geometric shape may be a collar that encompasses an angle range of 180° or more.

In the coupled state, the male connector and the socket may be connected in such a manner that they are unable to rotate relative to one another. It is thus possible by way of example for an axially protruding web of the male connector to engage in a complementarily shaped receiving facility of the socket or conversely, wherein in a positive-locking manner the web and the receiving facility prevent the male connector and the socket rotating relative to one another. Insofar as by way of example a sliding-block guide is provided for pre-stressing the ejection spring, it is possible for the releasing sleeve, which is to pre-stress the spring and possibly to be rotated, to be supported against the positive-locking anti-rotation arrangement between the male connector and the socket.

In order to achieve a compact construction, it is possible to provide that the sleeve, the male connector and the spring are arranged in an essentially coaxial manner with respect to one another.

The socket may be a wall feed-through.

BRIEF DESCRIPTION OF THE DRAWINGS

The invention is described in detail below with the aid of a drawing illustrating exemplary embodiments. In each case in the drawing showing schematically:

FIG. 1G-FIG. 1K shows the separation of the plug connection for the apparatus from FIG. 1A;

DETAILED DESCRIPTION

Figure 1A:
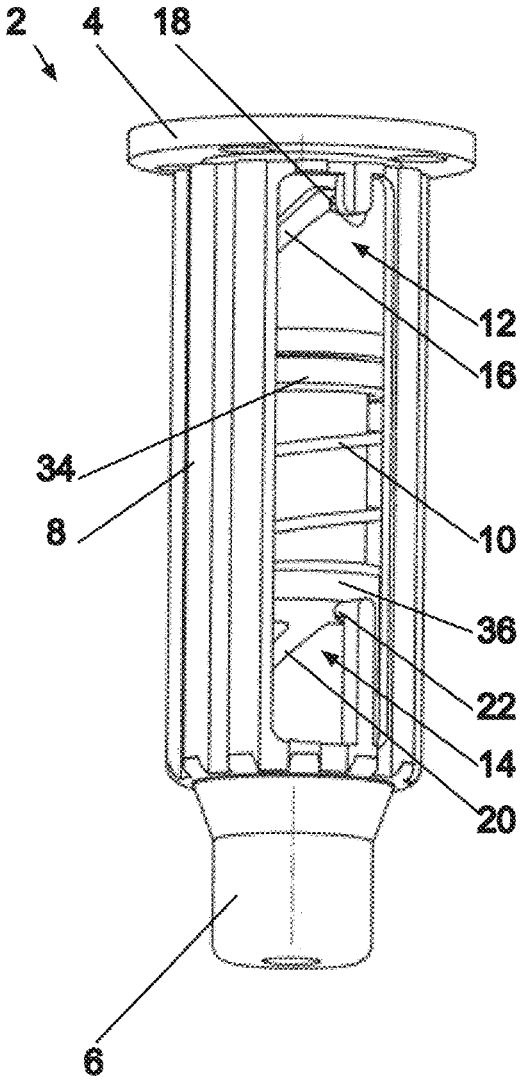
FIG. 1A shows a first apparatus in accordance with the invention in a side view.
Figure 1B:
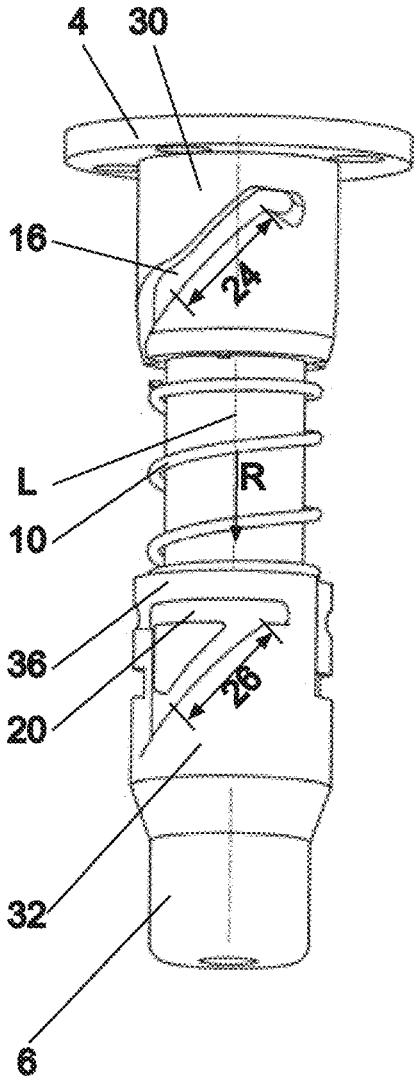
FIG. 1B shows the apparatus from FIG. 1A without a releasing sleeve.

FIG. 1A illustrates an apparatus 2 for connecting and separating an electrical connection. The apparatus 2 has a socket 4 and a male connector 6 that may be connected to the socket 4.

The apparatus 2 has moreover a coupling mechanism that is configured so as to lock the socket 4 to the male connector 6 and to separate it therefrom. The coupling mechanism has a releasable positive-locking connection for connecting the socket 4 and the male connector 6, a releasing sleeve 8 for releasing the releasable positive-locking connection and an ejection spring 10 for separating the socket 4 and the male connector 6.

Figure 1F:
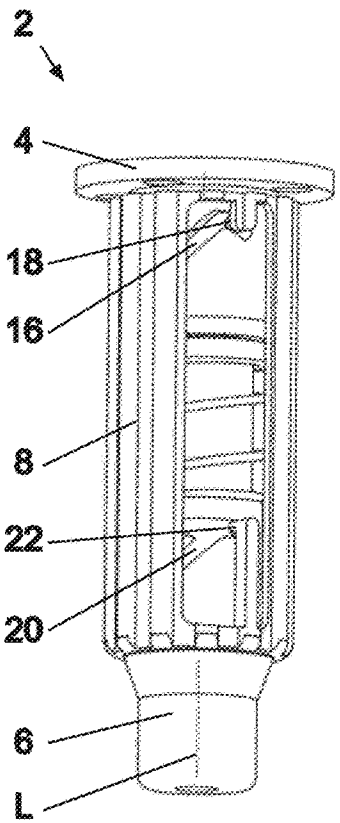
FIG. 1C-FIG. 1F shows the creation of a plug connection for the apparatus from FIG. 1A.
Figure 1E:
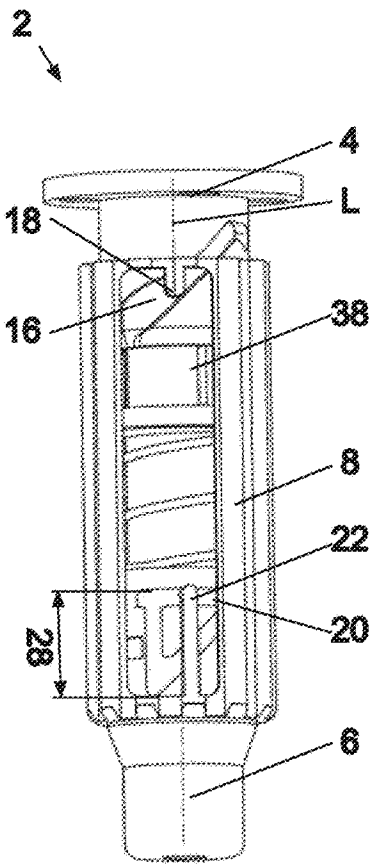

The socket 4 and the male connector 6 are in contact with one another in a first position A of the releasing sleeve 8 (FIG. 1A; FIG. 1F) and are secured by means of the releasable positive-locking connection to prevent them becoming detached or pulled apart in the axial direction along a longitudinal axis L.

The releasing sleeve 8 is movable out of the first position A into a second position B whilst the ejection spring is pre-stressed (FIG. 1I). The releasing sleeve 8 is configured so as upon reaching the second position B to release the positive-locking connection between the socket 4 and the male connector 6. The ejection spring 10 is configured so as after releasing the positive-locking connection to move the socket 4 and the male connector 6 apart in the axial direction along the longitudinal axis L and to separate them.

The releasable, positive-locking connection of the coupling mechanism has a first sliding-block block 12, which is formed between the releasing sleeve 8 and the socket 4, and a second sliding-block guide 14, which is formed between the releasing sleeve 8 and the male connector 6. The first sliding-block guide 12 and the second sliding-block guide 14 are configured so as to cause a superimposed rotatory and axial translatory movement of the releasing sleeve 8 out of the first position A into the second position B.

The first sliding-block guide 12 has a first bayonet groove 16 in which a first molded element is guided. The second sliding-block guide 14 has a second bayonet groove 20 in which a second molded element 22 is guided.

The first bayonet groove 16 and the second bayonet groove 20 each have a pre-stressing groove section 24, 26 along which the sleeve 8 is movable so as to pre-stress the spring 10 out of the first position A into the second position B.

The pre-stressing groove section 26 of the second bayonet groove 20 issues into a releasing groove section 28 that extends in an axial manner at least in sections and along which the associated molded element 22 is guided starting from the second position B of the releasing sleeve 8 into a third position C (FIG. 1J, 1K) of the releasing sleeve 8, while the ejection spring 10 moves the male connector 6 and the socket 4 apart supported against the molded element 18 and the bayonet groove 16.

The first bayonet groove 16 of the first sliding-block guide 12 is arranged at the peripheral side in the region of an outer peripheral surface 30 of the socket 4. The second bayonet groove 20 of the second sliding-block guide 14 is arranged in the region of an outer peripheral surface 32 of the male connector 6.

The pre-stressing section 24 of the first bayonet groove 16 and the pre-stressing section 26 of the second bayonet groove 20 are each inclined according to a type of helical section relative to an axial pre-stressing direction R of the ejection spring and the longitudinal axis L. An incline of the pre-stressing section 24 of the first bayonet groove 16 is equal to the incline of the pre-stressing groove section 26 of the second bayonet groove 20.

The first molded element 18 is a first cam 18 that is provided on the sleeve 8 and is guided in the first bayonet groove 16. The second molded element 22 is a second cam 22 that is provided on the sleeve 8 and is guided in the second bayonet groove 20.

The ejection spring 10 is received and may be pre-stressed between a collar 34, which is formed on the releasing sleeve 8, and a collar 36, which is formed on the male connector 6. The ejection spring 10 is not pre-stressed in the first position A of the releasing sleeve 8 and is at a distance from the collar 34.

With regard to FIGS. 1C to 1F, the creation of a connection between the socket 4 and the male connector 6 is explained below.

The male connector 6 supports the releasing sleeve 8 and the ejection spring 10. The releasing sleeve 8 is in this case already guided with the cam 22 in the bayonet groove 20.

The male connector 6 has an axially protruding molded element 38 that is to be received in a complementarily shaped receiving facility 40 of the socket 4.

Figure 1D:
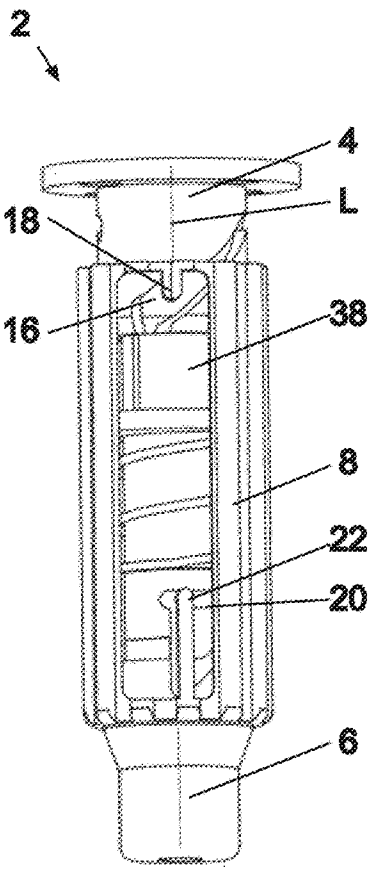
Figure 1C:
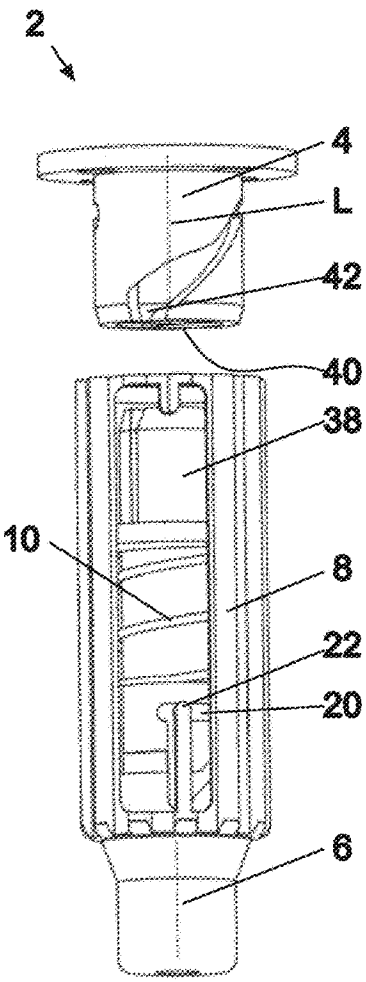

For this purpose, the male connector 6 is moved in the direction of the socket 4, wherein the movement occurs in a translatory manner along the longitudinal axis L. In this case, the cam 18 of the releasing sleeve 8 is fed into an opening 42 on the groove end of the bayonet 16 (FIG. 1*c*, FIG. 1D).

The further insertion of the axially protruding molded element 38 into the complementarily shaped receiving facility opening 40 causes the releasing sleeve 8 to rotate about the longitudinal axis L, wherein the cams 18, 22 are guided in the bayonet grooves 16, 20.

In the end position illustrated in FIG. 1F, when the plug connection has been fully created, the releasing sleeve 8 is in its position A. As already mentioned above, an electrically conductive or galvanic connection is formed between the male connector 6 and the socket 4 for the position A of the releasing sleeve 8.

When creating the connection between the socket 4 and the male connector 6, it is accordingly possible for an operator to grasp the male connector 6 and by way of pushing the male connector 6 into the socket 4 in a translatory manner to cause the rotation of the sleeve 8 into its position A (FIG. 1C to FIG. 1F). Alternatively, after feeding the cam 18 into the bayonet groove 16 (FIG. 1D), a user may grasp the releasing sleeve 8 and move said releasing sleeve by rotating it into its position A, wherein the rotation of the sleeve and the sliding of the cams 18, 22 along the bayonet grooves 16, 20 causes the socket 4 to be pulled onto the male connector 6.

With regard to FIGS. 1G to 1K, the procedure of separating the connection between the socket 4 and the male connector 6 is described below.

Starting from the position A of the releasing sleeve 8 illustrated in FIG. 1F, the releasing sleeve 8 is set in rotation about the longitudinal axis L by a user with the result that the cams 18, 22 slide along the pre-stressing groove sections 24, 26 and pre-stress the ejection spring 10 (cf. FIG. 1G, FIG. 1H). While the cams 18, 22 are sliding along the pre-stressing groove sections 24, 26, the socket 4 and the male connector 6 are secured or latched by the cams 18, 22 and the groves 24, 26 in an axial positive-locking manner to prevent said socket and male connector becoming detached or pulled apart. Consequently, when the spring is pre-stressed, the axial relative position between the socket 4 and the male connector 6 does not change.

Upon reaching the second position B of the releasing sleeve (FIG. 1I), the positive-locking axial connection of the socket 4 and the male connector 6 is released since the cam 22 is now movable in the axial direction along the releasing groove section 28 in the direction of the ejection spring 10. The rotation of the releasing sleeve 8 about the longitudinal axis L therefore causes the pre-stressing of the ejection spring 10 and as the cam 22 passes the site when the pre-stressing groove section 16 issues into the releasing groove section 28 the positive-locking axial connection between the socket 4 and the male connector 6 is released. After the connection has been released, the ejection spring 10 may now move the socket 4 and the male connector 6 apart in the axial direction supported against the cam 18 and the bayonet groove 16 (FIG. 1J) in order to fully separate the socket 4 and the male connector 6 from one another (FIG. 1K).

The FIGS. 2A to 2H illustrate a further exemplary embodiment of an apparatus 44 in accordance with the invention for connecting and separating an electrical connection. The apparatus 44 has a sleeve 46 and a male connector 48 that may be connected to the socket 46.

The apparatus 44 has moreover a couple mechanism that is configured so as to lock the socket 46 to the male connector 48 and to separate it therefrom, wherein the coupling mechanism has a releasable, positive-locking connection for connecting the socket 46 and the male connector 48, a releasing sleeve 50 for releasing the releasable positive-locking connection and an ejection spring 52 for separating the socket 46 and the male connector 48.

Figure 2A:
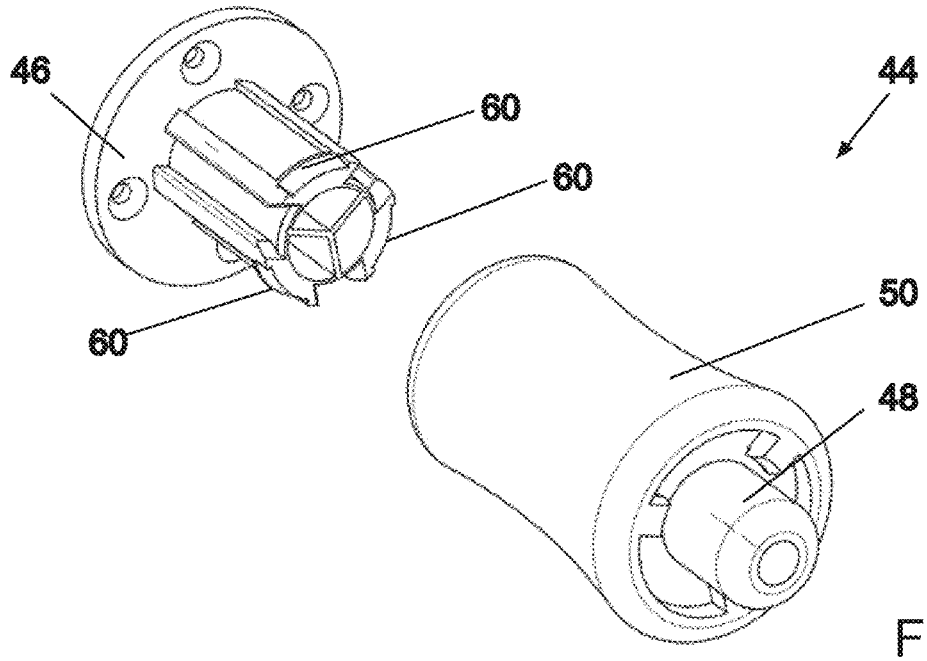
FIG. 2A shows a second apparatus in accordance with the invention in a perspective view.
Figure 2B:
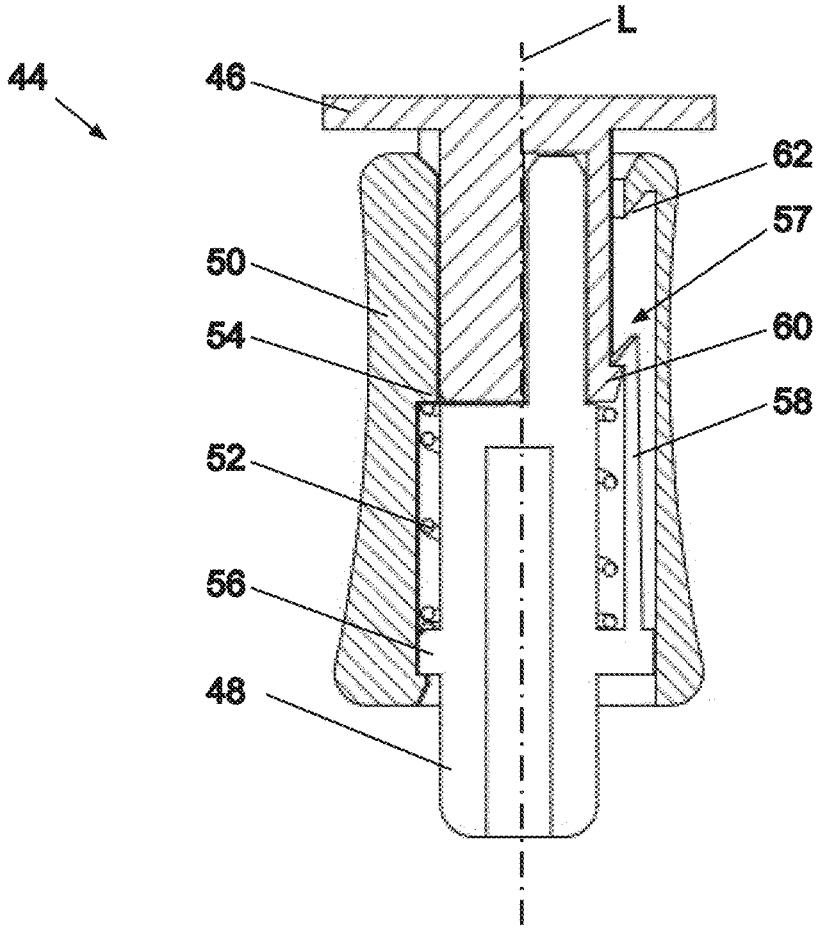
FIG. 2B shows the apparatus from FIG. 2A in the longitudinal sectional view.
Figures 2C, 2D, 2E, 2F, 2G, 2H:
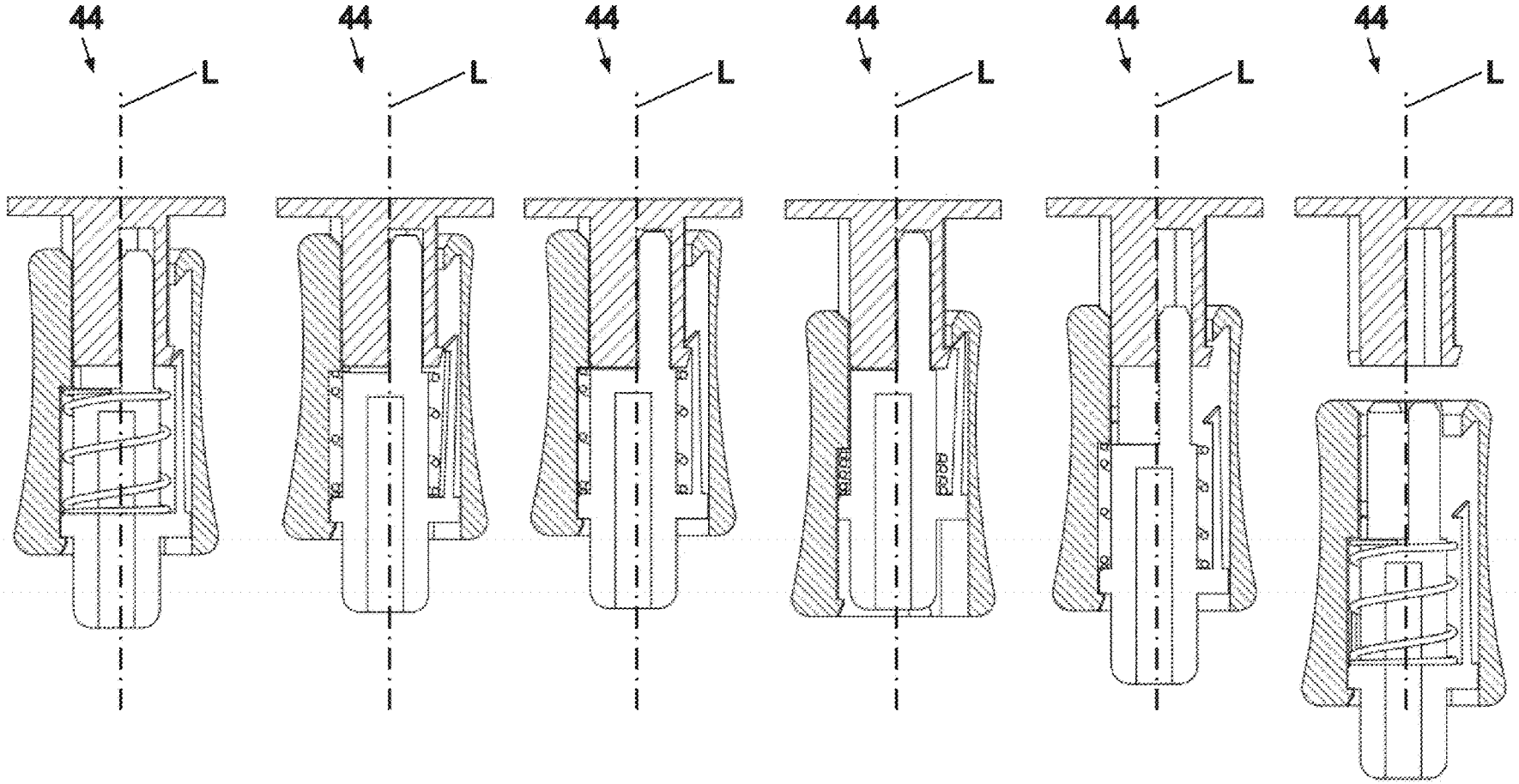
FIG. 2C-FIG. 2E shows the creation of a plug connection for the apparatus from FIG. 2A.
FIG. 2F-FIG. 2H shows the separation of the plug connection for the apparatus from FIG. 2A.

The socket 46 and the male connector 48 are in contact with one another in a first position A of the releasing sleeve 50 (FIG. 2B; FIG. 2E) and secured by means of the releasable positive-locking connection to prevent said socket and male connector becoming detached in the axial direction.

The releasing sleeve 50 is movable out of the first position A (FIG. 2B; FIG. 2E) into a second position B (FIG. 2G) while the ejection spring 52 is pre-stressed. The releasing sleeve 50 is configured so as upon reaching the second position to release the positive-locking connection between the socket 46 and the male connector 48. The ejection spring 52 is configured so as after releasing the positive-locking connection to move the socket 46 and the male connector 48 apart in the axial direction along a longitudinal axis L and to separate them.

The ejector spring 52 is received and may be stressed between a collar 54, which is formed on the releasing sleeve 50, and a collar 56, which is formed on the male connector 48.

The ejector spring 52 is not pre-stressed in the first position A of the releasing sleeve 50 (FIG. 2B; FIG. 2E).

The releasable, positive-locking connection has a clip connection 57 that is formed between the socket 46 and the male connector 48, said clip connection having spring arms 58 that engage in undercuts 60 in order to couple the male connector 48 and the socket 46 in an axial manner and to secure said socket and male connector to prevent them becoming detached or pulled apart.

In order to connect the socket 46 and the male connector 48, the socket 46 and the male connector 48 are pushed one inside the other in an axial manner along the longitudinal axis L until the clip connection 56 is formed (FIG. 2C to FIG. 2E).

The releasing sleeve 50 has a releasing geometric shape 62 that is configured so as upon reaching the second position B to raise the spring arms 58 from the undercuts 60 and to release the clip connection 57 (FIG. 2F). The releasing geometric shape 62 is a collar 62 that is circumferential in sections.

After the clip connection 57 is released, the ejection spring 52 relaxes and moves the socket 46 and the male connector 48 apart in an axial manner along the longitudinal axis L (FIG. 2G) until the socket 46 and the male connector 48 are fully separated (FIG. 2H).

In the coupled state, the male connector 48 and the socket 46 are connected, preferably in a positive-locking manner, in such a manner that they are unable to rotate relative to one another.

The socket 46, the male connector 48 and the ejection spring 52 are arranged in an essentially coaxial manner with respect to one another along the longitudinal axis L.

The FIGS. 3A to 3*h* illustrate a further exemplary embodiment of an apparatus 64 in accordance with the invention for connecting and separating an electrical connection.

The apparatus 64 has a socket 66 and a male connector 68 that may be connected to the socket 66. The apparatus 64 has a coupling mechanism that is configured so as to lock the socket 66 to the male connector 68 and to separate it therefrom.

The coupling mechanism has a releasable positive-locking connection for connecting the socket 66 and the male connector 68, a releasing sleeve 70 for releasing the releasable positive-locking connection and an ejection spring 72 for separating the socket 66 and the male connector 68.

Figure 3C:
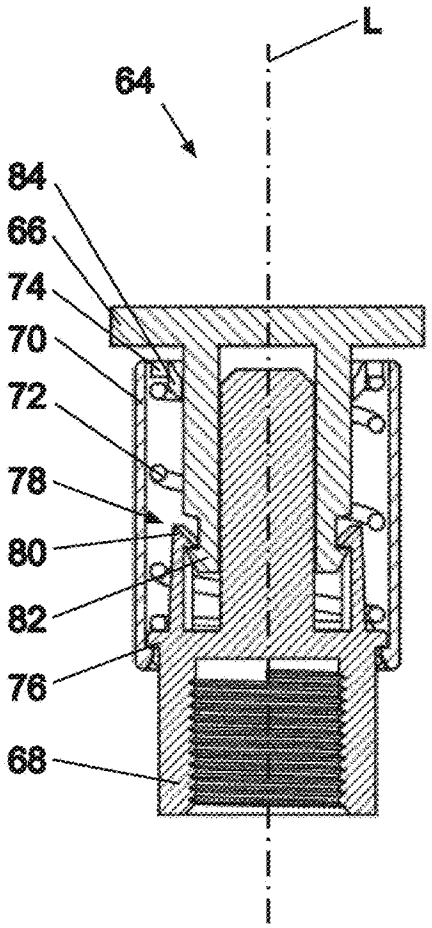
FIG. 3C shows the apparatus from FIG. 3A in the longitudinal sectional view.
Figure 3B:
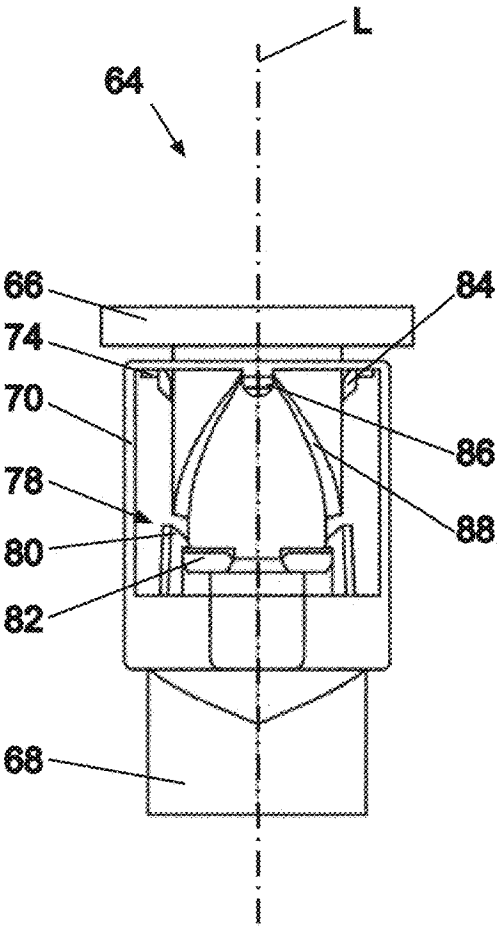
FIG. 3B shows the apparatus from FIG. 3A without an ejection spring.
Figure 3A:
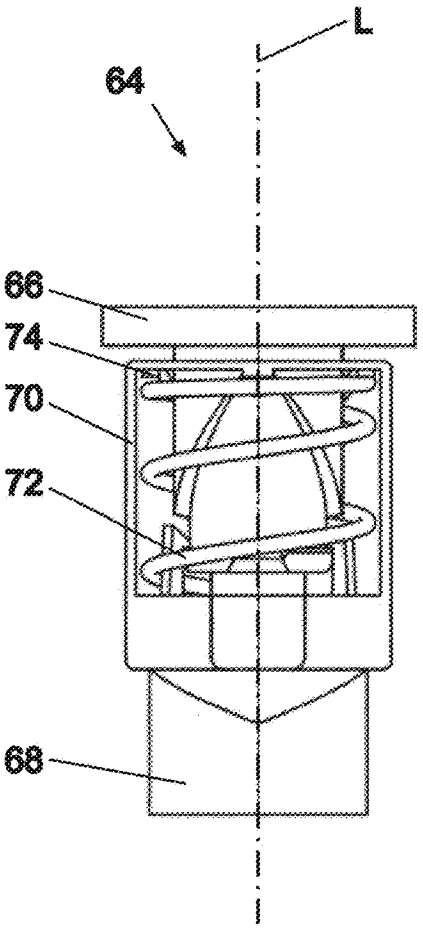
FIG. 3A shows a third apparatus in accordance with the invention in a side view with a releasing sleeve in position A.

The socket 66 and the male connector 68 are in contact with one another in a first position A of the releasing sleeve 70 and are secured by means of the releasable positive-locking connection to prevent said socket and male connector becoming detached in the axial direction along the longitudinal axis L (FIG. 3A; FIG. 3B; FIG. 3C).

Figure 3F:
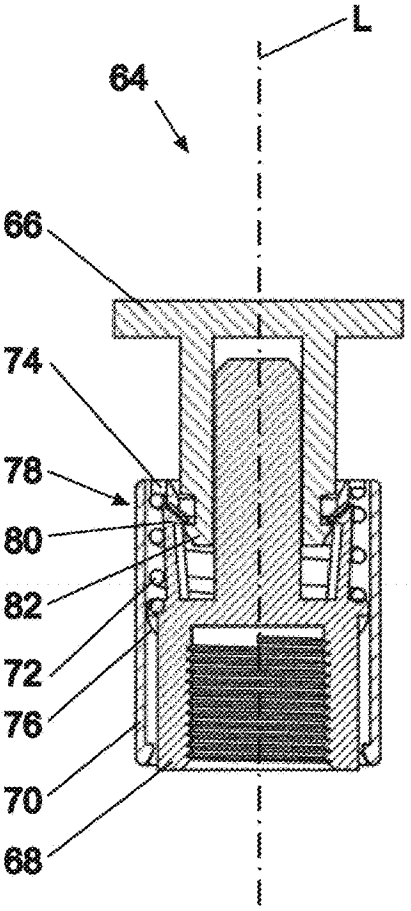
FIG. 3F shows the apparatus from FIG. 3D in the longitudinal sectional view.
Figure 3E:
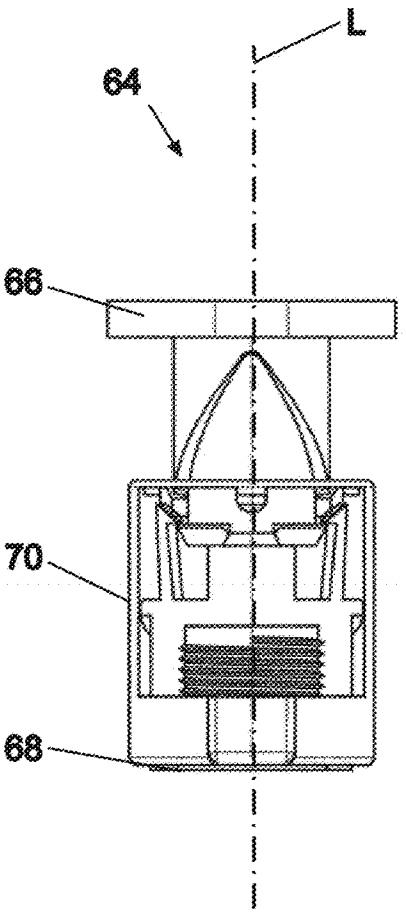
FIG. 3E shows the apparatus from FIG. 3D without an ejection spring.

The releasing sleeve 70 is movable out of the first position A (FIG. 3A; FIG. 3B; FIG. 3C) in accordance with a first variant in a purely translatory manner along the longitudinal axis L into a second position B1 (FIG. 3D; FIG. 3E; FIG. 3F) while the ejection spring 72 is pre-stressed. In accordance with a further releasing variant of the apparatus 64, the releasing sleeve 70 is movable in a translatory and rotatory manner into positions B2 or B3.

The releasing sleeve 70 is configured so as upon reaching the second position B1, B2 or B3 to release the positive-locking connection between the socket 66 and the male connector 68.

The ejection spring 72 is configured so as after releasing the positive-locking connection to move the socket 66 and the male connector 68 apart in an axial manner along the longitudinal axis L and to separate them.

The ejection spring 72 is received and may be pre-stressed between a collar 74, which is formed on the releasing sleeve 70, and a collar 76, which is formed on the male connector 68.

The ejection spring 72 is not pre-stressed in the first position A of the releasing sleeve 70 (FIG. 3A; FIG. 3C).

The releasable, positive-locking connection has a clip connection 78 that is formed between the socket 66 and the male connector 68 and has spring arms 80 that engage in undercuts 82.

Figure 3D:
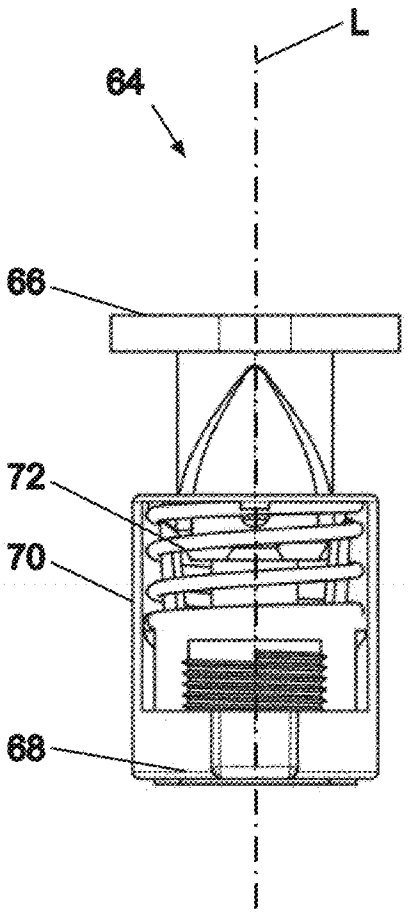
FIG. 3D shows the apparatus from FIG. 3A in a side view with the releasing sleeve in a position B1.

The releasing sleeve 70 has a releasing geometric shape 84 that is configured so as upon reaching the second position B1 (FIG. 3D; FIG. 3E; FIG. 3F) to raise the spring arms 80 from the undercuts 82 and to release the clip connection 78.

The releasing sleeve 70 has in addition to the releasing geometric shape 84 further molded elements 86 that are configured so as upon reaching the second position B2 or B3 to raise the spring arms 80 from the undercut 82 and to release the clip connection 78.

The further molded elements 86 are guided along a sliding-block guide 88 that is configured so as to cause a superimposed rotatory and axial translatory movement of the releasing sleeve 70 out of the first position A into the second position B2 or B3. It is thus possible as an alternative to the above described purely translatory movement for the releasing sleeve 70 to be moved along the sliding-block guide 88 by way of a rotation about the longitudinal axis in the clockwise direction (FIG. 3G) or by way of a rotation about the longitudinal axis in the anti-clockwise direction in order to release the clip connection 78 with the aid of the molded elements 86.

In the coupled state, the male connector 68 and the socket 66 are connected in such a manner that they are unable to rotate relative to one another.

The socket 66, the male connector 68 and the ejection spring 72 are arranged in an essentially coaxial manner with respect to one another.

Figure 3H:
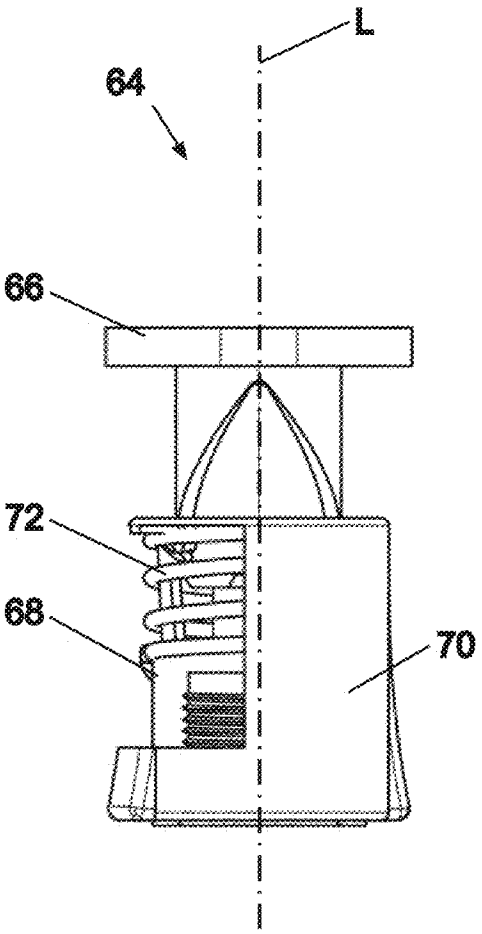
FIG. 3H shows the apparatus from FIG. 3A in a side view with the releasing sleeve in a position B3.
Figure 3G:
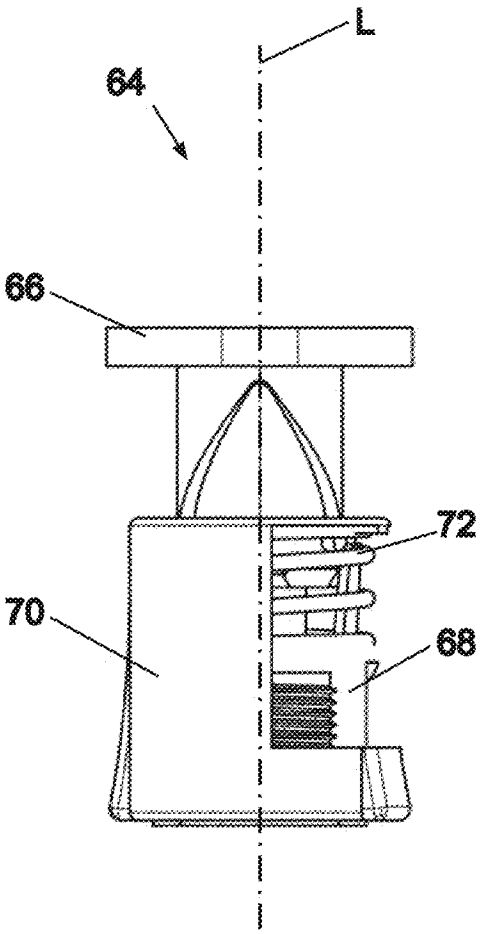
FIG. 3G shows the apparatus from FIG. 3A in a side view with the releasing sleeve in a position B2.

The releasing sleeve 70 may accordingly assume three different releasing positions B1, B2 and B3 and in fact by way of a purely translatory movement toward the releasing position B1 (FIG. 3F), by way of a rotation in the clockwise direction with a translatory movement toward the releasing position B2 (FIG. 3G) and by way of a rotation in the anti-clockwise direction with a translatory movement toward the releasing position B3 (FIG. 3H).

LIST OF REFERENCE NUMERALS

2 Apparatus
4 Socket
6 Male connector
8 Releasing sleeve
10 Ejection spring
12 First sliding-block guide
14 Second sliding-block guide
16 first bayonet groove
18 First molded element/cam
20 Second bayonet groove
22 Second molded element/cam
24 Pre-stressing groove section
26 Pre-stressing groove section
28 Releasing groove section
30 Outer peripheral surface
32 Outer peripheral surface
34 Collar
36 Collar
38 Molded element
40 Receiving facility
42 Opening
44 Apparatus
46 Socket
48 Male connector
50 Releasing sleeve
52 Ejection spring
54 Collar
56 Collar
57 Clip connection
58 Spring arms
60 Undercuts
62 Releasing geometric shape/circumferential collar
64 Apparatus
66 Socket
68 Male connector
70 Releasing sleeve
72 Ejection spring
74 Collar
76 Collar
78 Clip connection
80 Spring arms
82 Undercuts
84 Releasing geometric shape
86 Molded elements
88 Sliding-block guide
A First position
B Second position
B1 Second position
B2 Second position
B3 Second position
C Third position
L Longitudinal axis
R Pre-stressing direction

What is claimed is:

1. An apparatus to connect and separate an electrical connection, comprising:
- a socket;
- a male connector connectable to the socket;
- a coupling mechanism configured to lock the socket to the male connector and separate the socket from the male connector, wherein the coupling mechanism comprises
  - a releasable positive-locking connection to connect the socket and the male connector;
  - a releasing sleeve to release the releasable positive-locking connection;
  - an ejection spring to separate the socket and the male connector;
  - wherein the socket and the male connector are in contact with one another in a first position of the releasing sleeve and are secured by the releasable positive-locking connection when the releasing sleeve is in the first position to prevent the socket and the male connector becoming detached in an axial direction;
  - wherein the releasing sleeve is movable out of the first position into a second position while the ejection spring is pre-stressed;
  - wherein the releasing sleeve is configured, upon reaching the second position, to release the positive-locking connection between the socket and the male connector; and
  - wherein the ejection spring is configured, after releasing the positive-locking connection, to move the socket and the male connector apart in an axially manner and separate the socket and the male connector.

2. The apparatus as claimed in claim 1, wherein the ejection spring is received, and optionally pre-stressed, between a collar, which is formed on the releasing sleeve, and another collar, which is formed on the male connector.

3. The apparatus as claimed in claim 1, wherein the ejection spring is not pre-stressed in the first position of the releasing sleeve.

4. The apparatus as claimed in claim 1, wherein:

in a coupled state, the male connector and the socket are connected such that the male connector and the socket are unable to rotate relative to one another; and/or the socket, the male connector and the ejection spring are arranged essentially in a coaxial manner with respect to one another.

5. The apparatus as claimed in claim 1, wherein a compression of the ejection spring increases as the releasing sleeve is moved from the first position to the second position.

6. The apparatus as claimed in claim 1, wherein:

the releasable positive-locking connection has a first sliding-block guide, which is formed between the releasing sleeve and the socket, and a second sliding-block guide, which is formed between the releasing sleeve and the male connector; and the first sliding-block guide and the second sliding-block guide are configured to cause a superimposed rotatory and axial, translatory movement of the releasing sleeve out of the first position into the second position.

7. The apparatus as claimed in claim 6, wherein:

the first sliding-block guide has a first bayonet groove in which a first molded element is guided;

the second sliding-block guide has a second bayonet groove in which a second molded element is guided, wherein the first bayonet groove and the second bayonet groove each have a pre-stressing groove section along which the releasing sleeve is movable to pre-stress the spring out of the first position into the second position, and wherein either the pre-stressing groove section of the first bayonet groove or the pre-stressing groove section of the second bayonet groove issues into a releasing groove section that extends in an axial manner at least in sections and along which the associated molded element is guided starting from the second position of the releasing sleeve into a third position of the releasing sleeve, while the ejection spring moves the male connector and the socket apart supported against the respective other molded element.

8. The apparatus as claimed in claim 7, wherein:

the first bayonet groove of the first sliding-block guide is arranged at a peripheral side in a region of an outer peripheral surface of the socket;

the second bayonet groove of the second sliding-block guide is arranged in a region of an outer peripheral surface of the male connector, wherein the pre-stressing section of the first bayonet groove and the pre-stressing section of the second bayonet groove are each inclined according to a type of helical section relative to an axial pre-stressing direction of the ejection spring, wherein an incline of the pre-stressing section of the first bayonet groove is equal to an incline of the pre-stressing groove section of the second bayonet groove, and wherein a first cam provided on the releasing sleeve is guided in the first bayonet groove and a second cam provided on the releasing sleeve is guided in the second bayonet groove.

9. The apparatus as claimed in claim 1, wherein:

the releasable positive-locking connection has a clip connection formable between the socket and the male connector, the clip connection having at least one spring arm engageable in at least one undercut; and the releasing sleeve has a releasing geometric shape that is configured, upon reaching the second position, to raise the at least one spring arm from the at least one undercut and to release the clip connection.

10. The apparatus as claimed in claim 9, wherein:

the releasing sleeve has, in addition to the releasing geometric shape, a further molded element that is configured, upon reaching the second position, to raise the spring arm from the undercut and to release the clip connection; and the further molded element is guided along a sliding-block guide configured to cause a superimposed rotatory and axial translatory movement of the releasing sleeve out of the first position into the second position.

11. The apparatus as claimed in claim 9, wherein the releasing geometric shape is a collar that is circumferential at least in sections.

* * * * *